US006845717B1

(12) United States Patent
Sauvestre

(10) Patent No.: US 6,845,717 B1
(45) Date of Patent: Jan. 25, 2005

(54) BULLET WITH AN INTERNALLY CARRIED SUB-PROJECTILE

(76) Inventor: Jean-Claude Sauvestre, 64, rue de la Valléo, 18230 Saint-Doulchard (FR)

( * ) Notice: Subject to any disclaimer, the term of this patent is extended or adjusted under 35 U.S.C. 154(b) by 0 days.

(21) Appl. No.: 10/018,182

(22) PCT Filed: Jun. 16, 2000

(86) PCT No.: PCT/FR00/01677

§ 371 (c)(1),
(2), (4) Date: Dec. 18, 2001

(87) PCT Pub. No.: WO00/79211

PCT Pub. Date: Dec. 28, 2000

(30) Foreign Application Priority Data

Jun. 18, 1999 (FR) ..... 99 07760

(51) Int. Cl.[7] ..... F42B 12/34; F42B 30/00; F42B 12/74

(52) U.S. Cl. ..... 102/518; 102/510

(58) Field of Search ..... 102/501, 506–510, 102/514–518, 398

(56) References Cited

U.S. PATENT DOCUMENTS

| | | | | | |
|---|---|---|---|---|---|
| 1,096,558 | A | * | 5/1914 | Newton | 102/510 |
| 1,322,662 | A | * | 11/1919 | Watson | 102/510 |
| 1,493,614 | A | * | 5/1924 | Dickerman | 102/510 |
| 3,881,421 | A | * | 5/1975 | Burczynski | 102/507 |
| 4,044,685 | A | * | 8/1977 | Avcin | 102/507 |
| 4,245,557 | A | * | 1/1981 | Knappworst et al. | 102/510 |
| 4,655,140 | A | * | 4/1987 | Schirneker | 102/508 |
| 4,685,397 | A | * | 8/1987 | Schuneker | 102/510 |
| 4,977,834 | A | * | 12/1990 | Denis | 102/507 |
| 5,160,805 | A | * | 11/1992 | Winter | 102/507 |
| 5,185,495 | A | * | 2/1993 | Petrovich et al. | 102/510 |
| 5,365,853 | A | * | 11/1994 | Petrovich et al. | 102/507 |
| 6,148,731 | A | * | 11/2000 | Winter | 102/509 |

FOREIGN PATENT DOCUMENTS

| | | | |
|---|---|---|---|
| AT | 395910 | * | 4/1993 |
| AT | 395 910 | | 4/1993 |
| EP | 918208 | * | 5/1999 |
| EP | 0 918 208 | | 5/1999 |
| FR | 2 555 728 | | 5/1985 |
| FR | 2 599 828 | | 12/1987 |
| WO | WO 9740334 | * | 10/1997 |
| WO | WO00/79211 | | 12/2000 |

OTHER PUBLICATIONS

International Search Report issued in connection with PCT/FR00/01677.

* cited by examiner

*Primary Examiner*—Jack W. Keith
*Assistant Examiner*—James S. Bergin
(74) *Attorney, Agent, or Firm*—Burns, Doane, Swecker & Mathis, L.L.P.

(57) ABSTRACT

The invention relates to ammunitions for weapons of all calibers. The inventive ammunition includes a bullet which has the same caliber as the weapon or which is under calibrated, comprising a center part (2) and a rear part (1) which can carry a fin (12). The bullet has a hole (5) which is drilled in the front surface of the forebody (4) in accordance with the axis of the bullet, containing an internally carried sub-projective (6) which is more rigid than the body of the bullet and is provided on the surface with several longitudinal ribs (7). The invention can be used for ammunition with sub-projectiles in all calibers of hunting weapons with a shotgun or rifled barrel.

7 Claims, 3 Drawing Sheets

BULLET WITH AN INTERNALLY CARRIED SUB-PROJECTILE

BACKGROUND OF THE INVENTION

1. Field of the Invention

The present invention relates to ammunition for small-, medium- and large-caliber weapons, and more particularly to a novel type of core bullet, particularly for hunting weapons, having improved efficiency, essentially against soft targets.

2. Description of Related Art

Core bullet ammunition comprises a fin-stabilized sub-projectile (core) associated with a sabot (or launcher) with the same caliber as the weapon, the entities lying in a crimped closed cartridge also comprising a primed case and a propellant charge. Ammunition of this type is described for example in patent FR-A-2 555 728.

Also known from other sources is various ammunition designed to deform upon impact, for example expansion munitions such as in application WO 97/40334, the head of which has slots constituting deformation initiators. U.S. Pat. No. 4,685,397 describes a bullet producing a similar effect by means of a cap which can be driven into a cylindrical hole formed along the axis of the head of the bullet, upsetting the walls outwardly. U.S. Pat. No. 3,881,421 describes a bullet in which the head is hollowed out to cause it to flatten upon impact with the target.

SUMMARY OF THE INVENTION

The present invention relates to bullet core ammunition and relates more specifically to the subprojectile, also known as the core. It is desirable for the core to deform upon impact with the target, but this deformation needs to be controlled and must not result in excessive dislocation into several small-sized core fragments which may prove dangerous. The subject of the invention is a device which makes it possible to obtain controlled deformation of the core upon impact with the soft parts of a target, while at the same time providing the body of the core with sufficient rigidity and cohesion to avoid the formation of multiple fragments and ensure the destruction of the hard parts of said target.

The device of the invention essentially consists of a bullet with the same caliber as the weapon or which is subcaliber, comprising a profiled front part, a central part, and a rear part which may bear fins, containing, along its axis, an internal core with rigidity greater than that of the body of the bullet.

More specifically, the device of the invention consists of a projectile with the same caliber as the weapon, or a subprojectile intended to be used in combination with a launcher which has the same caliber as the weapon, comprising a cylindrical insert with greater rigidity than the remainder of the body of the projectile or subprojectile, placed along its axis and extending at least up close to the front-face of the projectile or subprojectile.

According to one embodiment, the bullet according to the present invention comprises a profiled front part, a central part and a rear part which may carry fins, and the internal core is preferably of a length such that it extends over the front part and the central part of the bullet.

According to an alternative form of the present invention, the internal core passes all the way through the bullet and extends from the rear part to the front part of the bullet, and the rear part of the internal core may act as a support for fins, in the case of a fin-stabilized bullet.

This internal core, or insert, constitutes a "supported internal core" because it is inserted into the bullet and supported by it. In the remainder of the description, for reasons of simplicity, it may be termed "internal core" but is to be distinguished from the core that constitutes the sub-projectile of fin-stabilized subcaliber core bullets of the known art.

According to one advantageous embodiment, the internal core is housed in an axial hole which is open at the front of the bullet, and the front face of the internal core is set back from the front face of the front part of the bullet.

According to an alternative form of embodiment according to the present invention, the internal core may protrude, that is to say that its front end may extend out of the axial hole, and may even in certain instances lie forward of the front face of the bullet. Such an arrangement may be particularly advantageous in the case of fin-stabilized bullets.

The internal core may be made of a single element or of several consecutive elements arranged contiguously along the same axis. It may be advantageous, for example, to provide an internal core made of two elements. According to an alternative form of embodiment, the internal core may be of the controlled-fragmentation type and comprise elements which disperse upon impact, for example balls of a diameter roughly equal to that of the internal core. This form of embodiment makes it possible to obtain calibration fragments at the time of impact, and thus improve the lethality of the ammunition by creating secondary injuries.

The internal core, or insert, may be made, for example, of steel, copper, brass or aluminum alloy with high mechanical strength.

The body of the bullet may for example be made of copper or of brass containing 5 to 40% zinc, or a metal alloy with the desired mechanical properties, for example an aluminum or lead alloy. By comparison with conventional techniques, the technique of the invention has the advantage of allowing lead to be replaced completely or partially by another metal or alloy deemed to be non-polluting. In the case of a fin-stabilized bullet, the fins may be made of metal or polymer formed by working plastic over the metal body of the subprojectile, and it may have stabilizing fins.

According to an alternative form according to the present invention, the internal core and the body of the bullet are formed from one and the same base material, for example copper or brass. In this case, of course, the rigidity of the internal core is enhanced by known means so that it is greater than that of the body of the bullet. The internal core can then be manufactured at the same time as the bullet, from the same material.

The supported internal core, or insert, generally has the shape of a rod having symmetry of revolution and a constant, increasing or decreasing cross section, coaxial with the projectile, as shown in the appended figures. It may be advantageous to provide ribs on the cylindrical surface so as to improve the attachment of the insert to the body of the bullet. These ribs may be annular or helical or, as a preference, may be longitudinal ribs, there being two to six of them over part or all of the length of the cylinder, symmetrically with respect to the axis. In addition, the longitudinal ribs may serve to form rupture initiators on the front face of the bullet when the cylindrical insert is fitted by forcibly introducing it into the hole already bored along the axis of the bullet. If the bullet is obtained by cold deformation, the supported internal core, previously placed along the axis of the blank of the bullet, will impress its longitudinal ribs into the body material offset by means of a press and will thus create the desired rupture initiators.

These rupture initiators, by collaborating with the internal core, encourage the head of the bullet to deform upon impact by forming "petals" or by "mushrooming" into as many elements as there are ribs, around the central internal core which maintains its overall shape and acts as a structure holding the entirety together. They may be associated in combination with circular or longitudinal grooves made on the periphery of the bullet, preferably in the region to be "mushroomed", that is to say the region in which controlled deformation is brought about.

According to another alternative form, it is possible to provide two inserts or internal core elements arranged along the axis of the projectile, one behind the other in the hole bored in the subprojectile or in the body of the bullet.

BRIEF DESCRIPTION OF THE FIGURES OF THE DRAWINGS

As indicated above, the bullet may be of the spin- or fin-stabilized type. Spin-stabilized bullets are used in a weapon with a rifled barrel, so that the rifling of the barrel, by collaborating with a peg secured to the bullet, causes the latter to rotate about its axis. Fin-stabilized bullets can be used in smooth bore weapons.

The characteristics and advantages of the invention will become apparent in greater detail in the description below which relates to some non-limiting examples with reference to the appended drawings which depict:

FIG. 10: a view in part section of an alternative form of the full-caliber spin-stabilized bullet of FIG. 1, having a two-element internal core that passes all the way through.

DETAILED DESCRIPTION OF THE PREFERRED EMBODIMENTS

Figure 1:
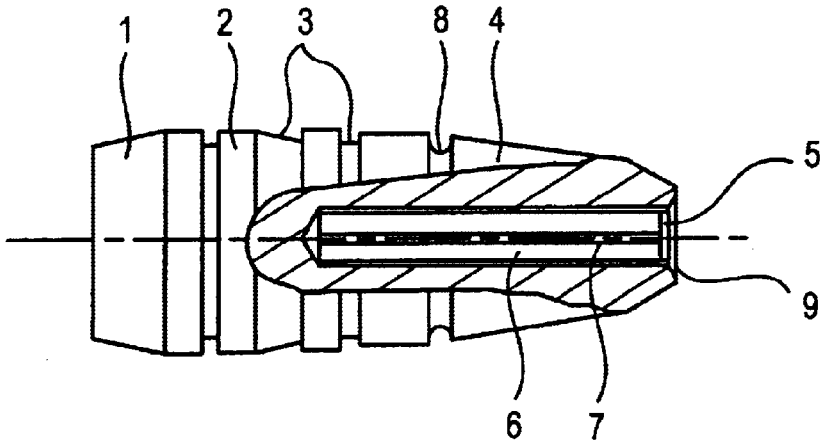
FIG. 1: a schematic view in part section of a spin-stabilized full-caliber bullet with an internal core according to the invention, for a hunting rifle.

As shown by FIG. 1, the full-caliber bullet comprises, at its rear part, a narrowed base (1), at its central part a body (2) on which circular grooves (3) are formed, at its front part, an ogive (4), all of this being partially introduced into a primed case containing a charge (not depicted).

A hole (5) is bored in the front face of the ogive (4) along the axis of the bullet and contains the supported internal core (6) provided on its surface with several longitudinal ribs (7). A conical mouth (9) makes it easier to initiate the "mushrooming".

Figure 2:
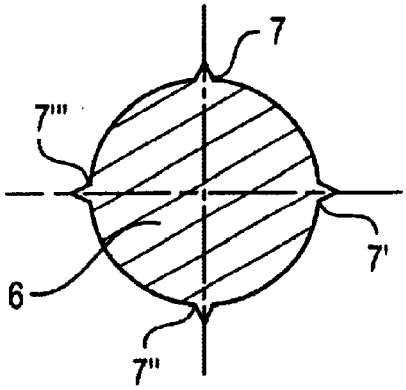
FIG. 2: a cross section of the internal core of the bullet of FIG. 1, on a larger scale.

FIG. 2 shows the position of four ribs (7) on the surface of the supported internal core (6) arranged symmetrically with respect to the axis and uniformly distributed around the periphery of the said core. The ridges of these ribs (7) bear against the interior wall of the hole (5). They have the advantage of causing the formation of rupture initiators in the thickness of the ogive (4) on the periphery of the hole (5) when the internal core forcibly inserted into the hole (5) is fitted during manufacture.

Figure 3:
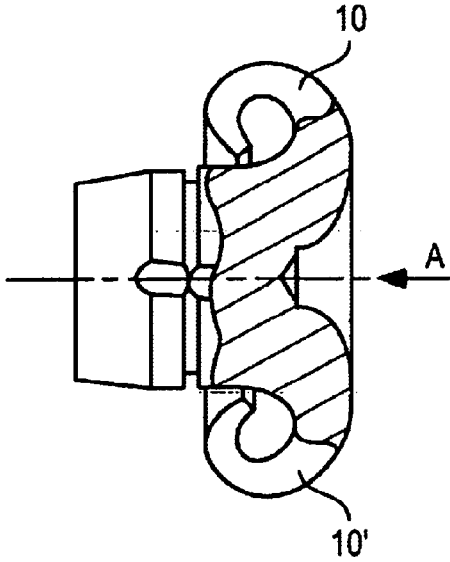
FIG. 3: a profile view, in part section, of the bullet of FIG. 1, following impact and penetration.
Figure 4:
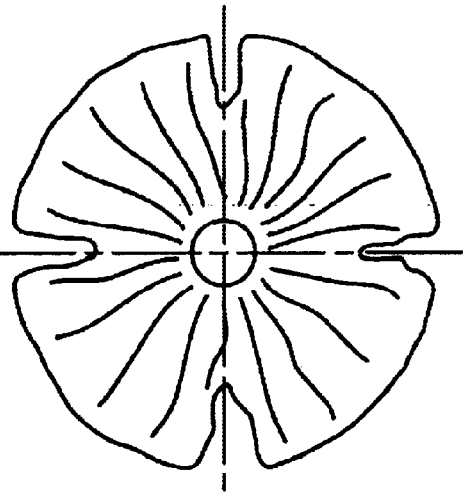
FIG. 4: a view in the direction of the arrow A of FIG. 3.

The ogive (4) may have one or more circular grooves (8) which facilitate the speed and ability of the petals (10) to roll back, as specified by FIGS. 3 and 4 so as better to control the deformation on impact and during the hit.

Figure 5:
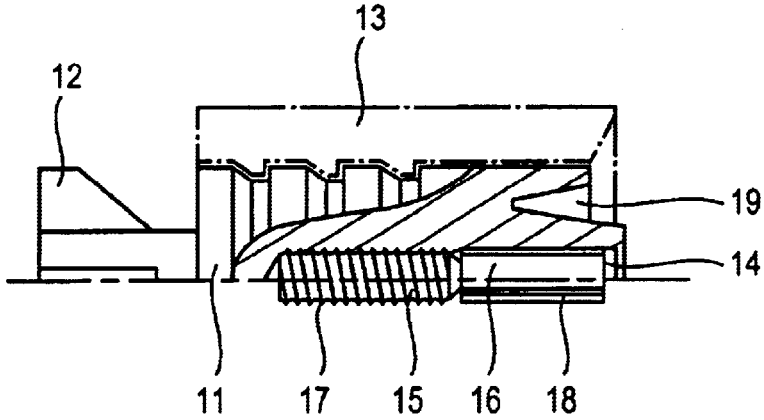
FIG. 5: a simplified half view in part section of a subcaliber bullet with supported internal cores according to the invention, for a hunting gun.

As FIG. 5 shows, the subcaliber bullet (11) is equipped with fins (12) at its rear part, and is enveloped by a launching sabot (13) depicted in dotted line, all this being in a primed case filled with charge, not depicted.

A hole (14) is bored in the front face of the bullet (11), along its axis, and contains two supported internal cores mounted in tandem as shown by FIG. 5. The rear supported internal core (15) has a helical furrow (17) in combination with the partial screwthread of the hole (14). The front supported internal core (16) bearing against the rear supported internal core (15) has several ribs (18) on its surface.

The ribs on the surface of the internal core (16) may number three, arranged symmetrically with respect to the axis. The ridges of these ribs press against the interior wall of the hole (14). The helical furrow (17) is formed at the surface of the rear supported internal core (16).

The front face (19) of the subcaliber bullet (11) may have an appropriate shape, collaborating with the metal insert to control the deformation upon impact. This annular front region (19) may, for example, have one of the shapes depicted in FIGS. 5*a* to 5*h* of French Patent 2 599 828. An illustration of the result obtained upon firing is specified in FIGS. 6 and 7.

Figure 8:
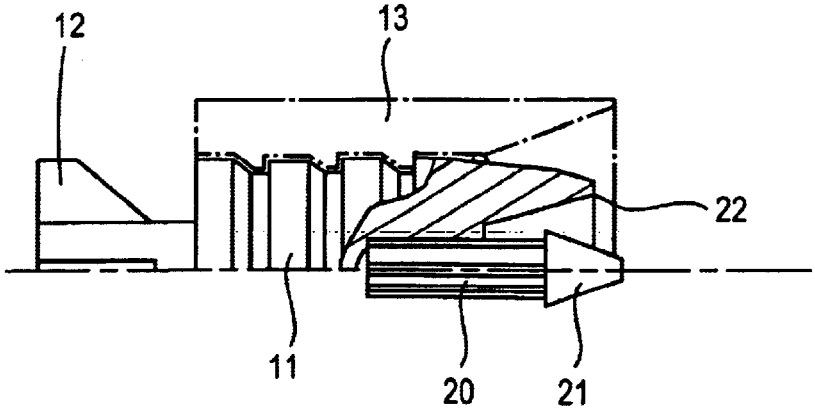
FIG. 8: a simplified half view in part section of an alternative form of the subcaliber bullet of FIG. 5, comprising a protruding internal core.

According to an alternative form of the fin-stabilized bullet of FIG. 5, the supported internal core is produced in protruding form, as indicated in FIG. 8 which shows the internal core, the front end of which extends beyond the front face of the bullet. In this embodiment, the internal core (20) comprises a head (21) of frustoconical shape, the small base facing forward. The two parts (20) and (21) of the internal core may of course consist of one and the same homogeneous part.

As shown by FIG. 8, a space separates the front face (22) of the bullet and the edge of the head (21) of the internal core, to make it easier for the bullet to deform upon impact with the target.

Figure 9:
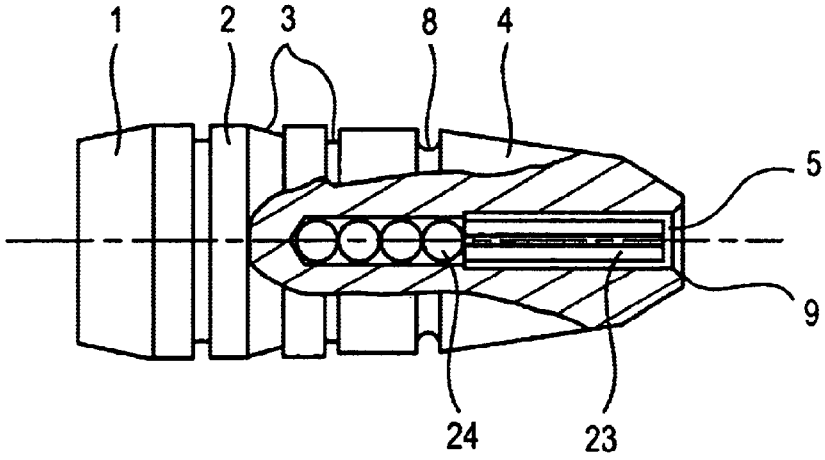
FIG. 9: a view in part section of an alternative form of the full-caliber spin-stabilized bullet of FIG. 1, comprising an internal core element associated with balls.

In the alternative form of full-caliber spin-stabilized bullet depicted in FIG. 9, the internal core comprises a front core element (23) associated with balls (24).

The rear element consists of several metal balls (24). The diameter of the balls is roughly equal to that of the internal core, which means that the balls are held in place in the axial hole (5) by the front element (23). Upon impact with the target, deformation of the head of the bullet is similar to that depicted in FIG. 3, and has the effect of causing the front element (23) of the internal core to detach and release the balls (24).

Figure 10:
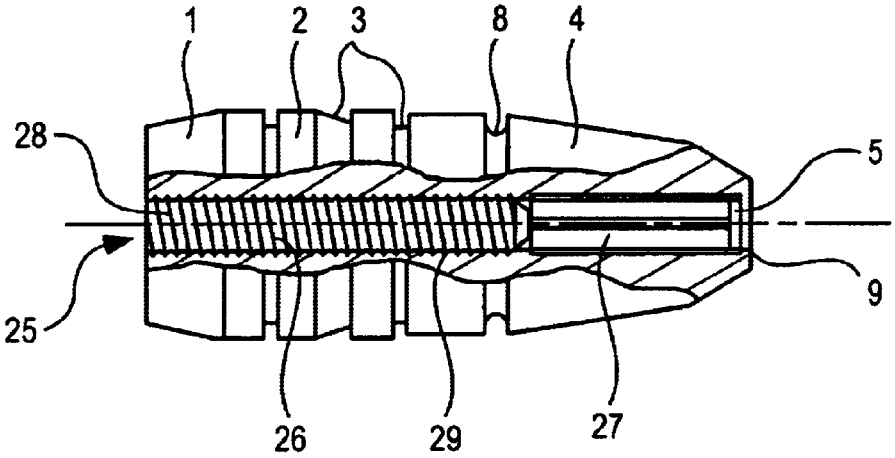

FIG. 10 depicts a spin-stabilized bullet with the same caliber as the weapon, similar to the one in FIG. 1, comprising a base (1), a body (2) provided with circular grooves (3) and a profiled front part (4), all this having passing all the way through it a hole (25) in which an internal core comprising a rear element (26) and a front element (27) is placed.

The rear element (26) of the core has a screwthread (28) collaborating with the tapping (29) formed on the interior surface of the hole (25). This arrangement allows the rear element (26) to be secured into the body of the bullet. By contrast, the front element (27) of the internal core is forcibly inserted into the front part of the hole (25).

Figure 11:
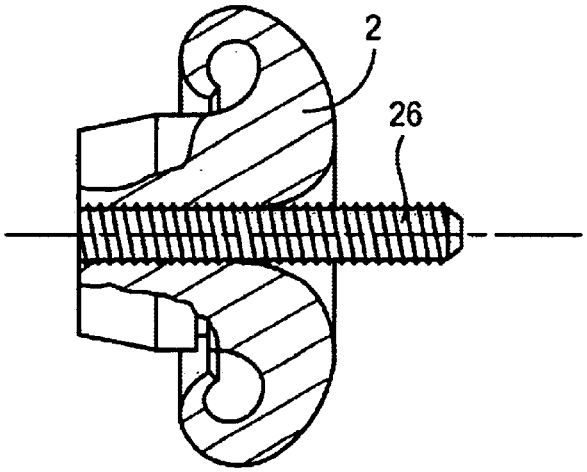
FIG. 11: a profile view in part section of the bullet of FIG. 10 following impact and penetration.

Upon impact with the target, the rear element (26) of the internal core remains secured to the body of the bullet, the front part of which is folded from the middle outward, as shown in FIG. 11, while the front element (27) of the internal core has been released.

Figure 6:
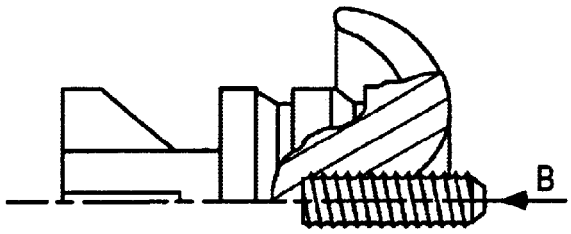
FIG. 6: a profile half view in part section of the subcaliber bullet of FIG. 5 following impact and penetration.
Figure 7:
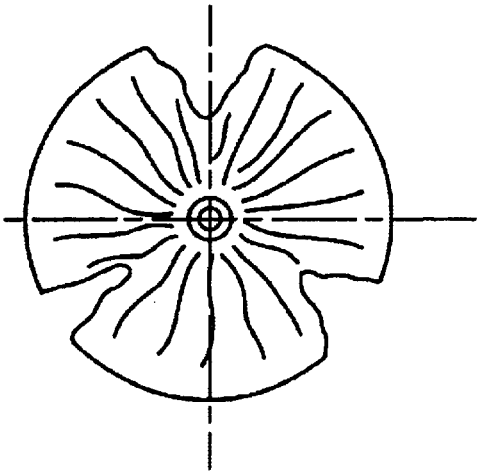
FIG. 7: a view in the direction of the arrow B of FIG. 6.

Tests carried out using ammunition according to the present invention, fired against blocks of plastics material (PLASTILINE®), demonstrated excellent effectiveness, particularly controlled deformation of the bullet upon impact with the target, as shown by FIGS. 3, 6 and 11, better than that of conventional lead ammunition.

The invention can be applied to core bullet ammunition for hunting weapons of all calibers, with smooth bore or rifled barrel.

What is claimed is:

1. Ammunition for small-, medium- and large-caliber weapons, comprising a bullet with the same caliber as the weapon or which is subcaliber, the bullet comprising a profiled front part, a central part, a rear part, and an internal core extending along an axis of the bullet, the internal core being housed in an axial hole in a body of the bullet, the axial hole being open at the front of the bullet, the internal core having rigidity greater than that of the body of the bullet, the internal core extending over the front part and the central part of the bullet, and the internal core having at least one longitudinal rib on an outer surface, wherein the front part of the bullet has a front face, and wherein a front face of the internal core is set back from the front face of the front part of the bullet.

2. The ammunition as claimed in claim 1, wherein the internal core consists of one single homogeneous element.

3. The ammunition as claimed in claim 1, wherein the internal core consists of a rod having symmetry of revolution, the rod having longitudinal ribs over part of its surface.

4. The ammunition as claimed in claim 3, wherein the internal core has two to six longitudinal ribs arranged symmetrically with respect to the axis.

5. The ammunition as claimed in claim 1, wherein the internal core is made of steel, brass, copper or aluminum alloy.

6. The ammunition as claimed in claim 1, wherein the body of the bullet is made of copper or brass containing 5 to 40% zinc.

7. The ammunition as claimed in claim 1, wherein the internal core has a substantially cylindrical outer surface having at least one outwardly projecting rib extending parallel to the axis.

* * * * *